US011772763B1

(12) United States Patent
Lin

(10) Patent No.: US 11,772,763 B1
(45) Date of Patent: Oct. 3, 2023

(54) MARINE ACCELERATING PROPELLER

(71) Applicant: SOLAS SCIENCE & ENGINEERING CO., LTD., Taichung (TW)

(72) Inventor: Yeun-Junn Lin, Taichung (TW)

(73) Assignee: SOLAS SCIENCE & ENGINEERING CO., LTD., Taichung (TW)

( * ) Notice: Subject to any disclaimer, the term of this patent is extended or adjusted under 35 U.S.C. 154(b) by 0 days.

(21) Appl. No.: 17/898,753

(22) Filed: Aug. 30, 2022

(30) Foreign Application Priority Data

Jul. 21, 2022 (TW) ..... 111127414

(51) Int. Cl.
*B63H 5/10* (2006.01)

(52) U.S. Cl.
CPC ..... *B63H 5/10* (2013.01); *B63H 2005/103* (2013.01)

(58) Field of Classification Search
CPC ..... B63H 5/10; B63H 2005/013
USPC ..... 416/124
See application file for complete search history.

(56) References Cited

U.S. PATENT DOCUMENTS 4,619,584 A * 10/1986 Brandt ..... B63H 20/16 416/201 A
5,807,151 A * 9/1998 Sumino ..... B63H 5/10 416/129
2019/0127035 A1* 5/2019 McKinny, Jr. ..... B63H 5/10

FOREIGN PATENT DOCUMENTS

CN 205256630 U 5/2016

* cited by examiner

*Primary Examiner* — Yi-Kai Wang
(74) *Attorney, Agent, or Firm* — MUNCY, GEISSLER, OLDS & LOWE, P.C.

(57) ABSTRACT

A propeller includes a propeller shaft, a plurality of first blades, and a plurality of second blades. The first blades are connected to the outer peripheral surface of the propeller shaft so as to be rotated synchronously with the propeller shaft. The second blades are connected to the outer peripheral surface of the propeller shaft, so that they are rotated in the same direction as the first blades. The second blades are located in front of the first blades and correspond to the first blades in a one-to-one manner. The size of the second blades is smaller than the size of the first blades, and the rotation direction of the second blades is the same as the rotation direction of the first blades. Thereby, the propeller of the present invention can improve the operation efficiency of the boat at high speed without increasing the size of the first blades.

4 Claims, 6 Drawing Sheets

MARINE ACCELERATING PROPELLER

BACKGROUND OF THE INVENTION

1, Field of the Invention

The present invention relates to marine propeller technology, and more particularly to a marine accelerating propeller.

2. Description of the Related Art

In order to increase the speed of ordinary boats, they usually choose to configure larger size propellers such as 16 inches or 17 inches). However, in addition to the high cost, the aforementioned large-sized propellers have a deep draft when in use, so when sailing in a shallow waterway, the operation safety of the boat may be affected due to the deep draft. Therefore, how to increase the driving speed without increasing the size of the propeller (the common size is 15.5 inches) is an urgent problem to be overcome by the industry at present.

In addition, the propeller will generate lateral flow and longitudinal wake during the rotation process, and the lateral flow will generate sailing resistance and affect the propulsion efficiency.

In order to limit the lateral flow and accelerate the longitudinal wake to improve the propulsion efficiency of the propeller, the propeller disclosed by CN205256630U improves the propulsion efficiency by means of a dual-flow structure. However, the outer blades and inner blades do not correspond to each other and the spiral directions are opposite, so the efficiency that can be improved in actual use is limited, so the practicability is not high.

SUMMARY OF THE INVENTION

The present invention has been accomplished under the circumstances in view. It is the main object of the present invention to provide a marine accelerating propeller, whiCh can improve the operation efficiency of the boat at high speed without increasing the size.

To achieve this and other objects of the present invention, the marine accelerating propeller comprises a propeller shaft, a plurality of first blades and a plurality of second blades. The first blades are connected to the outer peripheral surface of the propeller shaft. The second blades are connected to the outer peripheral surface of the propeller shaft and rotatable in the same direction with the first blades following the propeller shaft. The second blades are located in front of the first blades and correspond to the first blades in a one-to-one manner. The size of the second blades is smaller than the size of the first blades. The rotation direction of the second blades is the same as the rotation direction of the first blades.

As can be seen from the above, the propeller of the present invention reduces the lateral flow by the second blades with smaller sizes, and simultaneously increases the longitudinal wake by the second blades. In this way, the operating efficiency of the boat at high speed can be improved without increasing the size of these first blades.

Preferably, the second blades are 70% of the first blades in diameter.

Preferably, the second blades are one third of the first blades in area.

Preferably, in a projection direction parallel to the axial direction of the propeller shaft, each of the second blades completely falls within the range covered by the corresponding one of the first blades.

Preferably, the trailing edge of each second blade is located between the leading edges of two adjacent first blades. This can achieve the effect of reducing turbulence.

Preferably, the propeller shaft can be a one-piece structure, and can also be composed of a shaft body and a ring body set at the front end of the shaft body, wherein, the outer peripheral surface of the shaft body is connected to the first blades, and the outer peripheral surface of the ring body is connected to the second blades.

The detailed structure, characteristics, assembly or use of the marine accelerating propeller provided by the present invention will be described in the detailed description of the subsequent preferred embodiment. However, those with ordinary knowledge in the field of the present invention should be able to understand that these detailed descriptions and specific embodiments listed in the implementation of the present invention are only used to illustrate the present invention, not to limit the scope of the patent application of the present invention.

DETAILED DESCRIPTION OF THE INVENTION

Figure 1:
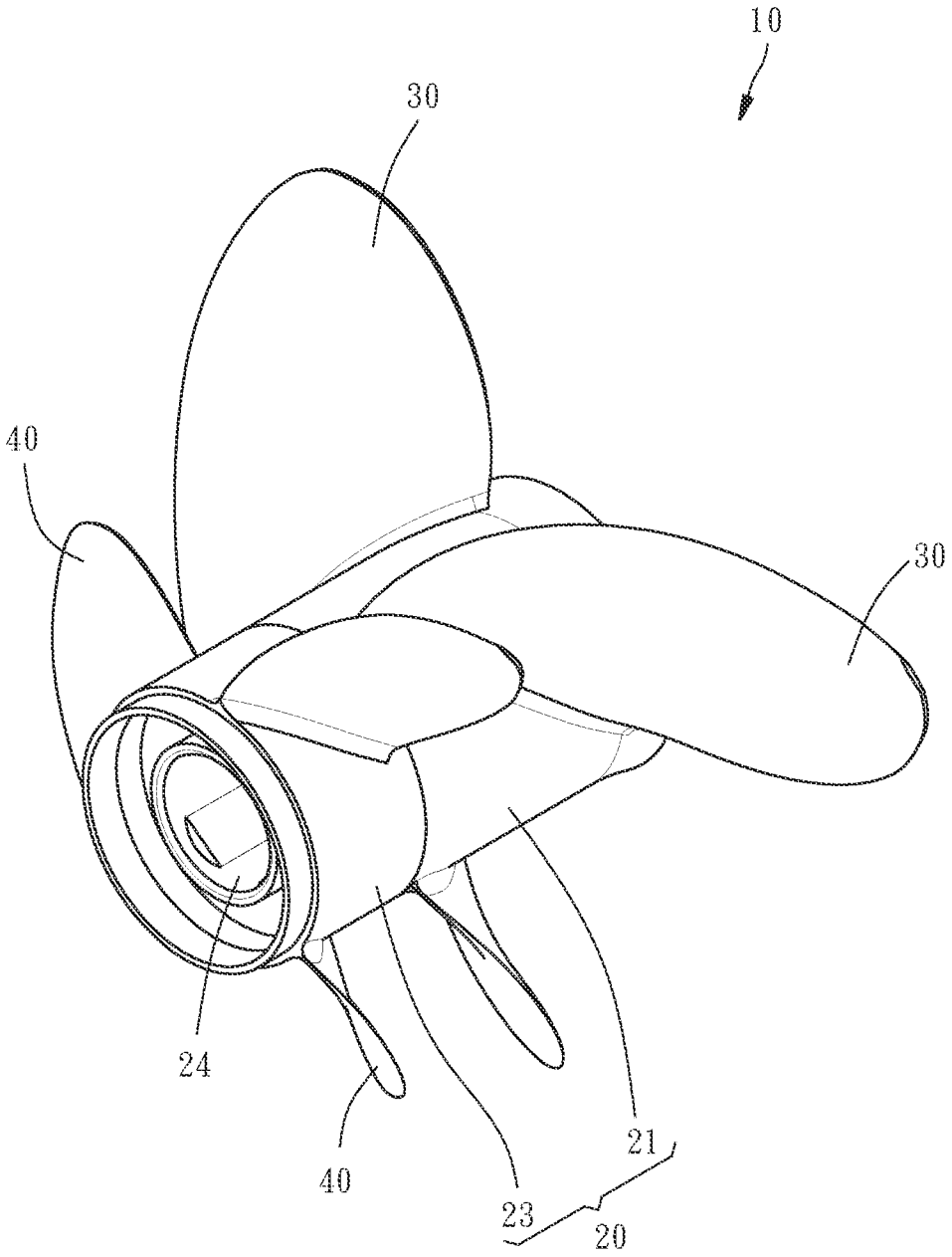
FIG. 1 is an oblique top elevational view of the marine accelerating propeller of the first embodiment of the present invention.

The applicant first states here that throughout the specification, including the preferred embodiments described below and the claims in the scope of patent application, the terms related to directionality are based on the directions in the drawings. Secondly, in the preferred embodiments and drawings to be described below, the same element numbers represent the same or similar elements or their structural features.

Figure 2:
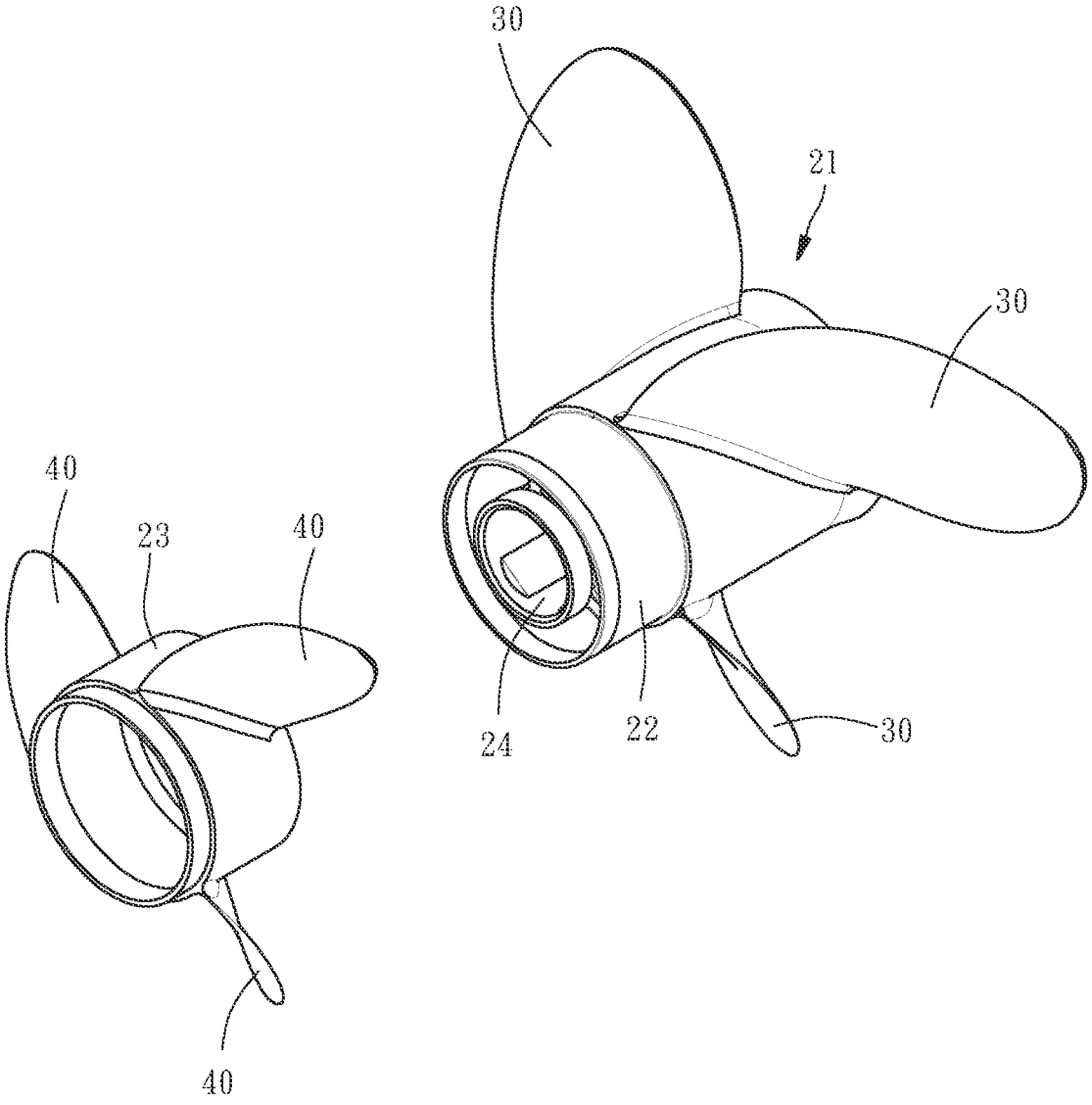
FIG. 2 is an exploded view of the marine accelerating propeller of the first embodiment of the present invention.
Figure 3:
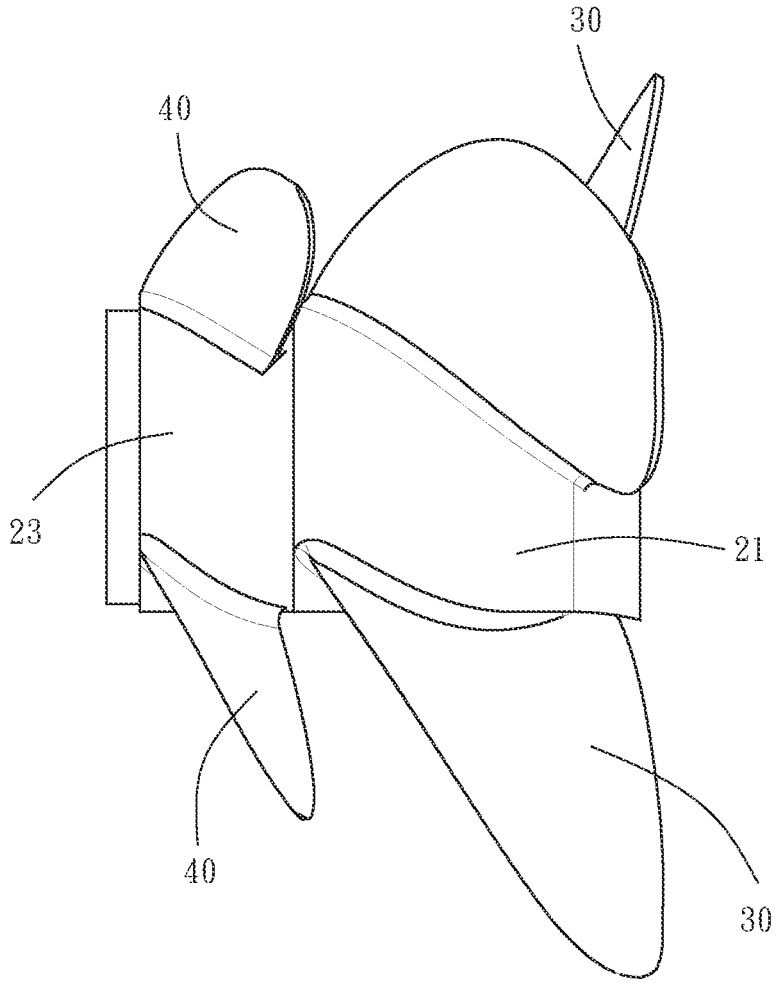
FIG. 3 is a side view of the marine accelerating propeller of the first embodiment of the present invention.
Figure 4:
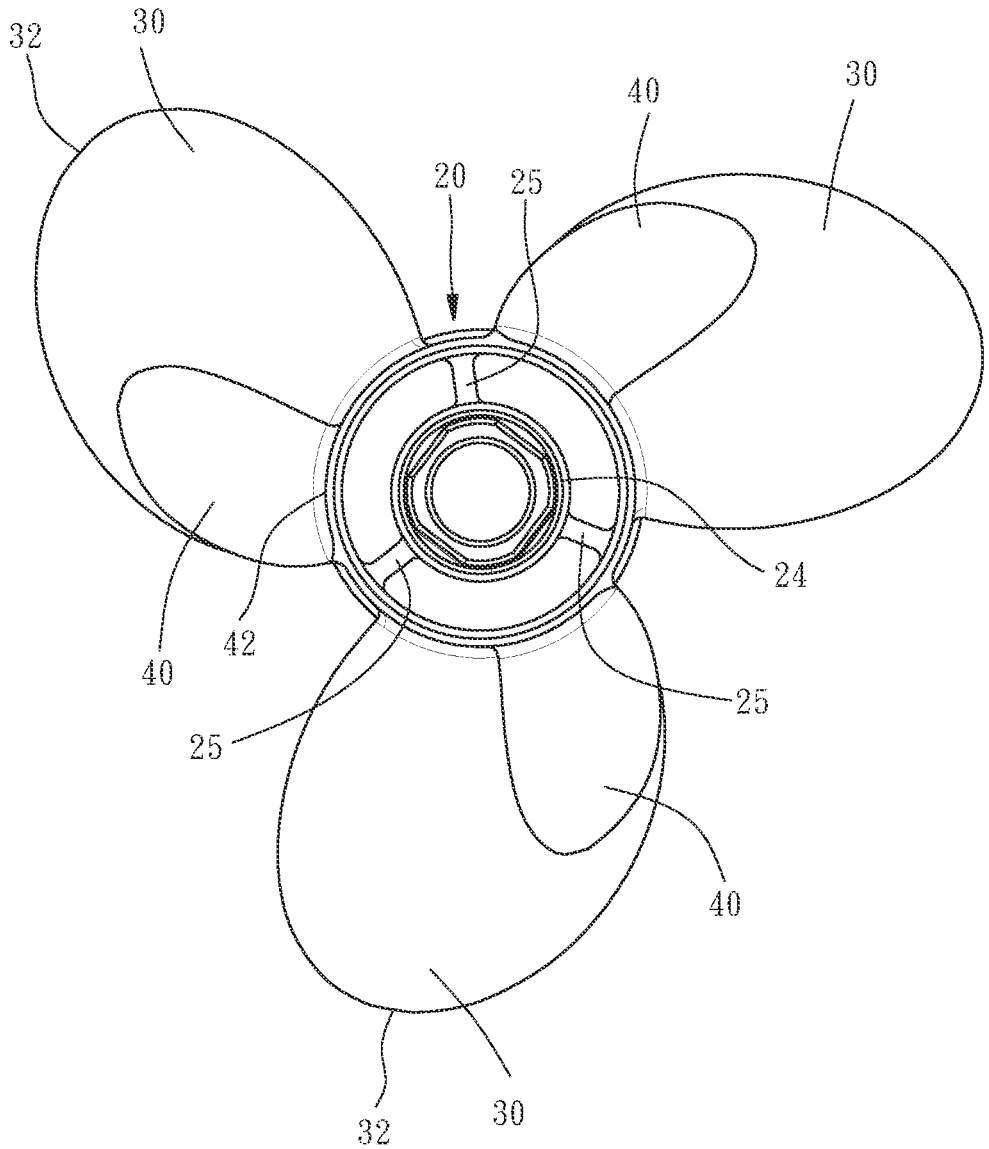
FIG. 4 is an end view of the marine accelerating propeller of the first embodiment of the present invention.

Referring to FIG. 1, the propeller 10 of the first embodiment of the present invention comprises a propeller shaft 20, a plurality of first blades 30, and a plurality of second blades 40. The propeller shaft 20 is a two-piece structure composed of a shaft body 21 and a ring body 23 in this embodiment. As shown in FIGS. 2 and 3, the front end of the shaft body 21 has a mounting portion 22, and the ring body 23 is fixed to the mounting portion 22 of the shaft body 21 by means of tight fitting or welding. In addition, the propeller shaft 20 further comprise a shaft sleeve 24, as shown in FIG. 2 and FIG. 4, the shaft sleeve 24 is arranged in the shaft body 21 and connected to the inner peripheral surface of the shaft body 21 through three ribs 25. The propeller shaft is connected to a power source (not shown) with the shaft sleeve 24, so that the propeller shaft 20 can be driven by the power source to rotate.

The first blades 30 are connected to the outer peripheral surface of the shaft body 21, so that the first blades 30 can run synchronously with the propeller shaft 20.

The second blades 40 are connected to the outer peripheral surface of the ring body 23, so that the second blades 40 can run synchronously with the propeller shaft 20 and rotate in the same direction as the first blades 30 through the propeller shaft 20 to provide a diversion effect.

As shown in FIG. 3 and FIG. 4, the second blades 40 are located in front of the first blades 30 and correspond to the first blades 30 in a one-to-one manner, and the size of the second blades 40 is smaller than that of the first blades 30. In this embodiment, the diameter of the second blades 40 is 11 inches, and the diameter of the first blades 30 is 15.5 inches, so the diameter of the second blades 40 is about 70% of the diameter of the first blades 30, and the area of the second blades 40 is about one third of the area of the first blades 30. In addition, the rotation direction of the second blades 40 is the same as that of the first blades 30. As shown in FIG. 4, on the projection direction parallel to the axial direction of the propeller shaft 20, the second blades 40 completely fall into the range covered by the corresponding first blades 30. Moreover, the trailing edge 42 of each second blade 40 is approximately in the middle of the leading edges 32 of two adjacent first blades 30, so that the effect of reducing turbulence can be achieved.

Figure 6:
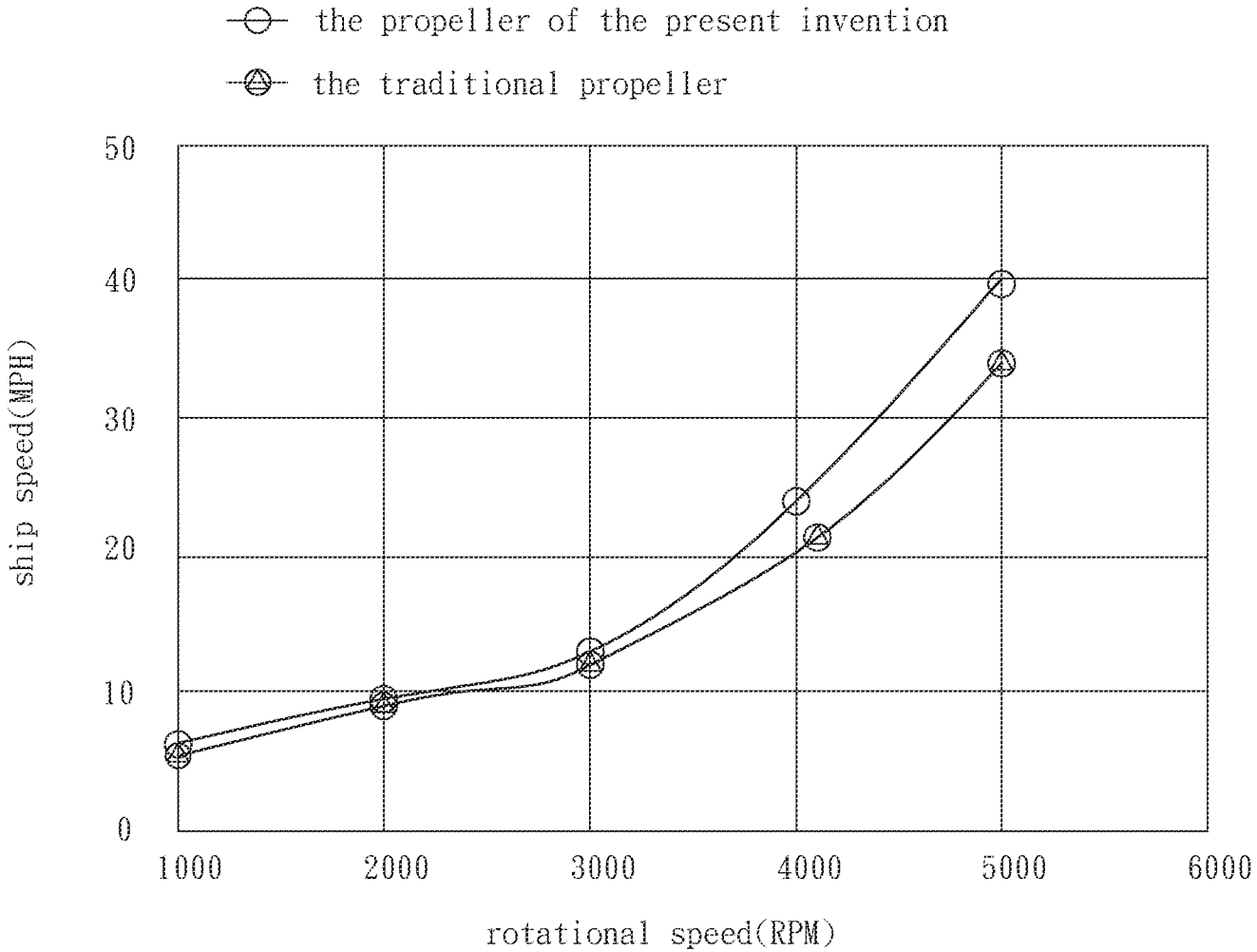
FIG. 6 is a graph of ship speed versus rotational speed for the propeller of the present invention and a conventional propeller.

As can be seen from the above, the propeller 10 of the present invention utilizes the propeller shaft 20 to drive the first blades 30 and the second blades 40 to run in the same direction. During the operation, the second blades 40 with smaller size reduces the lateral flow, and at the same time, the second blades 40 increases the longitudinal wake in the direction of the first blades 30, so as to reduce the sailing resistance and improve the propulsion efficiency. In addition, in FIG. 6, the traditional propeller only has the first blades 30, while the propeller 10 of the present invention has the first blades 30 and the second blades 40. As can be seen from FIG. 6 that when the rotational speed of the two is higher, the propeller 10 of the present invention will increase the ship speed more, so that the propeller 10 of the present invention can improve the operating efficiency of the boat at high speed without increasing the size of the first blades 30 (that is, keeping the size of 15.5 inches).

Figure 5:
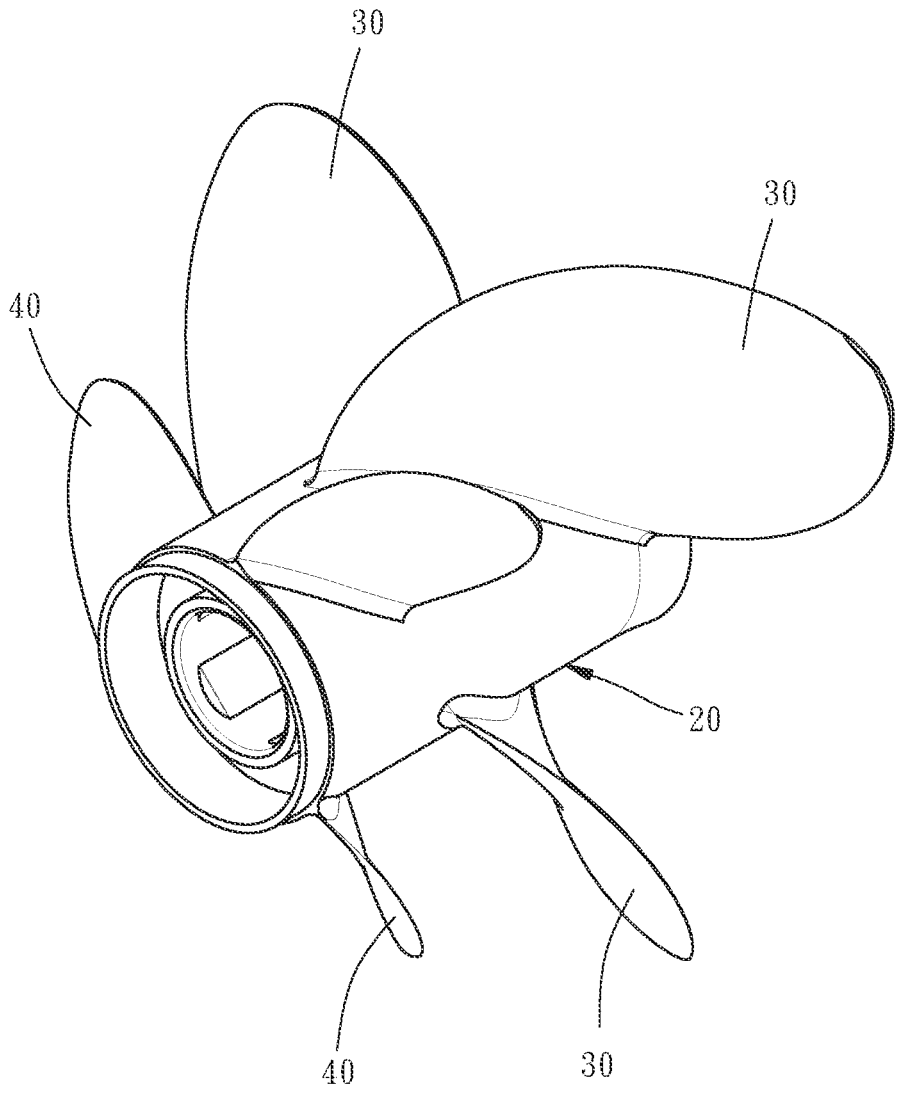
FIG. 5 is an oblique top elevational view of the marine accelerating propeller of the second embodiment of the present invention.

What needs to be supplemented at last is that propeller shaft 20 is not limited to two-piece structure, as shown in FIG. 5, the propeller shaft 20 can also be made in the mode of integral molding, and cooperate with the setting of the first blades 30 and the second blades 40 in the above-mentioned embodiment, the running efficiency of the boat can also be improved when running at high speed.

What is claimed is:

1. A marine accelerating propeller, comprising:

a propeller shaft;

a plurality of first blades connected to the outer peripheral surface of said propeller shaft; and a plurality of second blades connected to the outer peripheral surface of said propeller shaft and rotatable in the same direction with said first blades following said propeller shaft, said second blades being located at a front, upstream side relative to said first blades and corresponding to said first blades in a one-to-one manner, the size of said second blades being smaller than the size of said first blades, and the rotation direction of said second blades being the same as the rotation direction of said first blades;

wherein in a projection direction parallel to an axis of said propeller shaft, each of said second blades completely falls within a range covered by the corresponding one of said first blades, and a trailing edge of each of said second blades is located between leading edges of adjacent two of said first blades.

2. The marine accelerating propeller as claimed in claim 1, wherein said second blades are one third of said first blades in area.

3. The marine accelerating propeller as claimed in claim 1, wherein the diameter of said second blades is 70% of the diameter of said first blades.

4. The marine accelerating propeller as claimed in claim 1, wherein said first blades are connected to the outer peripheral surface of a shaft body, said second blades are connected to the outer peripheral surface of a ring body, and said ring body is fixed at a front end of said shaft body and forms said propeller shaft with said shaft body.

* * * * *